US006750895B1

(12) United States Patent
Otose et al.

(10) Patent No.: US 6,750,895 B1
(45) Date of Patent: Jun. 15, 2004

(54) OPTICAL PRINTER HEAD WITH INTEGRATED DRIVE CIRCUITRY

(75) Inventors: Tomohiko Otose, Tokyo (JP); Hideki Asada, Tokyo (JP); Tsutomu Uezono, Tokyo (JP); Atsushi Oda, Tokyo (JP); Satoru Toguchi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/670,596

(22) Filed: Sep. 29, 2000

(30) Foreign Application Priority Data

Sep. 29, 1999 (JP) ..... 11-277564

(51) Int. Cl.[7] ..... B41J 2/45; B41J 2/47

(52) U.S. Cl. ..... 347/238; 347/237; 347/247

(58) Field of Search ..... 347/234, 237, 347/238, 240, 247, 248, 251, 130, 132, 129; 345/79, 80, 76, 77; 438/35; 257/84, 88

(56) References Cited

U.S. PATENT DOCUMENTS

| | | | | | |
|---|---|---|---|---|---|
| 4,947,160 | A | * | 8/1990 | Leksell et al. | 345/79 |
| 5,597,740 | A | * | 1/1997 | Ito et al. | 438/35 |
| 5,789,766 | A | * | 8/1998 | Huang et al. | 257/88 |
| 5,936,657 | A | * | 8/1999 | Fork | 347/237 |
| 6,011,575 | A | * | 1/2000 | Haneda | 347/238 |
| 6,072,517 | A | * | 6/2000 | Fork et al. | 347/237 |
| 6,137,523 | A | * | 10/2000 | Fork | 347/237 |
| 6,175,345 | B1 | * | 1/2001 | Kuribayashi et al. | 345/76 |
| 6,480,212 | B1 | * | 11/2002 | Shimoda et al. | 347/129 |

FOREIGN PATENT DOCUMENTS

| | | | | |
|---|---|---|---|---|
| JP | 58-65682 | | 4/1983 | |
| JP | 61-182966 | | 8/1986 | |
| JP | 62-284759 | | 12/1987 | |
| JP | 2-122953 | | 5/1990 | |
| JP | 3-183574 | | 8/1991 | |
| JP | 4-348961 | | 12/1992 | |
| JP | 5-57953 | * | 3/1993 | B41J/2/44 |
| JP | 5-169723 | | 7/1993 | |
| JP | 8-108568 | | 4/1996 | |
| JP | 8-156300 | | 6/1996 | |
| JP | 9-131919 | | 5/1997 | |
| JP | 9-136449 | | 5/1997 | |
| JP | 9-254437 | | 9/1997 | |
| JP | 10-119351 | | 5/1998 | |
| JP | 11-99697 | | 4/1999 | |
| JP | 11-198433 | | 7/1999 | |
| JP | 2001-18441 | | 1/2001 | |

* cited by examiner

*Primary Examiner*—Hai Pham
(74) *Attorney, Agent, or Firm*—Whitham, Curtis & Christofferson, P.C.

(57) ABSTRACT

An optical printer head with a plurality of light-emitting devices arranged in two dimensions is capable of providing a desired amount of exposure using light-emitting devices having even small luminance, ease of corrections to a sensitivity of a photosensitive body and to a positional displacement of an object to be printed, performing printing on multiple gray scales and implementing high density and miniaturization. The optical printer head is so configured that a picture element array including picture elements containing light-emitting devices arranged in line and string directions in two dimensions, a horizontal scanning circuit to feed data signals to each picture element string in the picture element array and a vertical scanning circuit to sequentially select and activate each picture element in the picture element array are formed on a same insulating substrate to support production of the above effects. The luminance of the picture elements is also made variable by use of a plurality of light-emitting devices and/or variable drive for each picture element to enhance the continuity of gray scale achieved.

16 Claims, 9 Drawing Sheets

OPTICAL PRINTER HEAD WITH INTEGRATED DRIVE CIRCUITRY

BACKGROUND OF THE INVENTION

1. Field of the Invention

The present invention relates to an optical printer head to expose a photosensitive body in a xerography-type printer.

2. Description of the Related Art

Conventionally, as a xerography-type printer, a laser printer and/or line-illuminant type optical printer are known. The laser printer produces printed outputs by causing modulated laser light generated through modulation of laser light based on data to be output to scan on a photosensitive drum, using two or more lens systems and polygon mirrors, to expose an image and to develop it. Since the laser printer can provide a higher speed, higher image quality and lower noise when compared with a dot-impact type printer or ink-jet type printer or a like and allows printing on ordinary paper, it is not only widely used for business applications but also is finding widespread use in households in recent years.

The line-illuminant type optical printer is a printer which uses a line illuminant composed of light emitting devices arranged in a form of a line. Since each of the arranged light emitting devices irradiates a corresponding spot on a photosensitive body, it has an advantage in that a scanning optical system is not required, which serves to implement high reliability and miniaturization of optical printers.

FIG. 13 is a side view showing overall configurations of conventional optical printer using a line illuminant. The conventional optical printer using the line illuminant, as shown in FIG. 13, is chiefly composed of a data inputting device 101, an optical printer head 102, a converging rod lens array 103, a photosensitive drum 104, a charging device 105, a developing device 106, a transferring device 107, a charge removing device 108 and a cleaning device 109.

Operations of the optical printer using the line illuminant will be hereinafter described by referring to FIG. 13.

Print data fed from the data inputting device 101 is input to a driving circuit (not shown) of the optical printer head 102. An output from the driving circuit activates the optical printer head 102 to cause the line illuminant to emit light. The photosensitive drum 104 is irradiated with light emitted by the activation of the optical printer head 102 and converged by the converging rod lens array 103. A surface of the photosensitive drum 104 is uniformly pre-charged by the charging device 105. A charge is removed from an area of the surface irradiated with the light by the optical printer head 102 and an electrostatic latent image is written to the photosensitive drum 104. Electrically charged fine grains (toner) are deposited on a surface of the photosensitive drum 104 to which the electrostatic latent image has been written and the electrostatic latent image is developed by the developing device 106 and a toner image is generated. The toner image having reached an object to be printed 110 through rotation of the photosensitive drum 104 is transferred to the object to be printed 110 by electric fields applied from the transferring device 107 and then a transferred toner image is fixed on the object to be printed 110 by a fixing device (not shown). Residual charge being left on the surface of the photosensitive drum 104 after it has passed through the transferring device 107 is removed by the charge removing device 108 and finally the toner being left on the surface of the photosensitive drum 104 after it has been transferred is removed by the cleaning device 109.

Moreover, a line-illuminant type optical printer head is disclosed in Japanese Patent Application Laid-open No. Sho58-65682 in which an LED (Light Emitting Diode) arranged in a form of a line is used as a line illuminant. An LED-type optical printer head uses a ceramic substrate made from alumina on which LED chips are arranged in the form of a line. IC (Integrated Circuit) chips operating as driving circuits are die-bonded to both sides of the ceramic substrate by using a conductive paste and then electrical connections are established by wire bonding and electrical signals and power are supplied through a FPC (Flexible Printing Cable) from a printer proper to the ceramic substrate. Due to size limitation imposed by an n-type GaAsP (Galium Arsenide Phosphide) substrate and to yield limitation imposed by manufacturing processes, LED chips of 64 dots or 128 dots with about 60 $\mu$m pitches are used presently. Therefore, to form the line illuminant of the optical printer head, it is necessary to arrange a plurality of such LED chips and, if accuracy of arrangement must be increased, cutting and/or mounting technologies with a high accuracy in the order of microns are required. Moreover, the n-type GaAsP substrate is small and costly and further has many defects. That is, in a case of monolithic type LED chips, an increase of numbers of light-emitting dots causes a lowered yield of LED chips and a rise in manufacturing costs. To avoid this, LED chips having the small number of light-emitting dots are mass-produced and are arranged by a length being equivalent to a printing width required by an object to be printed. However, an increase in density of the optical printer head by this method leads to packaging limitation imposed by arrangements and electrical connections of the LED chips. Therefore, the LED-type optical printer head has limits to lower manufacturing costs and higher density.

Therefore, a possibility of using light-emitting devices other than the LED is examined. For example, an optical printer head using an organic EL (electroluminescence) thin-film light emitting device is disclosed in Japanese Patent Application No. Hei8-108568. In a case of the optical printer head using the organic EL thin-film light emitting device, a large number of light-emitting devices can be formed, collectively and at comparatively lower costs, on a substance with a large area and mass production of the optical printer head is made possible. Moreover, by microfabrication of an electrode of the optical printer head, the density of the optical printer head is made higher.

Generally, in the optical printer head, even if an emitting device has a small light-emitting luminance, by arranging light-emitting devices in two dimensions, it can be used for short time exposure processes. For example, in Japanese Patent Application No. Hei9-254437, an optical printer head is disclosed in which light-emitting devices are arranged in two dimensions and a picture element array with a cluster of optical fibers incorporated on a front panel is used as a printer head.

However, the optical printer head using thin-film emitting devices such as organic EL devices or a like has a problem. That is, since a maximum light emitting luminance of present organic EL devices is hundreds cd/m$^2$ for a lifetime of scores of thousands of hours, when used for a printer head, it is difficult to satisfy both of requirements of light amounts required for exposure and practical lifetime (to be measured by required pieces of paper to be printed) at a same time. Though light-emitting operation with high luminance would be made possible by sacrificing the requirement of the lifetime and by using a replacement-type optical printer head, it is impossible to perform exact positioning among the optical printer head, photosensitive drum and optical system with an accuracy in the order of microns at a user level.

The followings are problems common to xerography-type printers:

(1) Correction is needed to a sensitivity characteristic of a photosensitive body.

(2) Correction is needed to a positional displacement of an object to be printed.

(3) Correction is needed to insufficient development that may occur in a region having small exposure amounts when printing on multiple gray scales is performed.

Since a characteristic of a surface potential of the photosensitive body does not always correspond linearly to the amount of exposure, the printer must be driven in accordance with the characteristic of a photosensitive body. Moreover, since the positional displacement of the object to be printed causes the degradation of print quality, this correction must be performed without fail. Also, since the problem of insufficient development in the region having small amounts of exposure, in general, is likely to arise in the conventional photosensitive body, some measures are necessary as in the other two cases.

Furthermore, another problem is that, when the light-emitting device is arranged in two dimensions, the number of driving circuits, wirings or like mounted outside the optical printer head inevitably increase with increases in the number of the light-emitting devices, thus interfering with higher density and miniaturization of the printer head.

SUMMARY OF THE INVENTION

In view of the above, it is an object of the present invention to provide an optical printer head with a plurality of light-emitting devices arranged in two dimensions which is capable of providing a desired amount of exposure using light-emitting devices having small light-emitting luminance, of making easy corrections to a sensitivity of a photosensitive body and to a positional displacement of an object to be printed, of performing printing on multiple gray scales and of implementing high density and miniaturization.

According to a first aspect of the present invention, there is provided an optical printer head including:

a picture element array composed of picture elements containing light-emitting devices arranged in directions of a line and a string in two dimensions;

a horizontal scanning circuit to feed data signals to each picture element string in the picture element array;

a vertical scanning circuit to sequentially select and activate each picture element line in the picture element array; and;

whereby the picture element array, horizontal scanning circuit and vertical scanning circuit are formed in a same insulating substrate.

By configuring as above, high density and miniaturization of the optical printer head are made possible. Moreover, since the exposure is repeated two or more numbers of times by a plurality of light-emitting devices arranged in a vertical scanning direction, on a same spot on a photosensitive body, even when a light-emitting device having a small amount of light to be emitted is used, desired amounts of exposure can be provided.

In the foregoing, a preferable mode is one wherein the light-emitting device is composed of organic electroluminescence devices.

Also, a preferable mode is one wherein the horizontal scanning circuit and vertical scanning circuit are composed of poly-crystal silicon thin-film transistors.

Also, a preferable mode is one that wherein includes a means for setting amounts of light to be emitted from the light-emitting device in picture elements constituting the picture element lines by each picture element line constituting the picture element array.

By configuring as above, an amount of light to be emitted by the light-emitting device of the picture element line existing on a low image density side can be larger than that of light to be emitted by the light-emitting device of the picture element line existing on a high image density side and therefore a problem that an output image becomes too white on the low image density side, can be solved.

Also, a preferable mode is one wherein the vertical scanning circuit is so operated that, in a state in which the picture element array is disposed facing a surface of a photosensitive body in a manner that a direction of the picture element line is parallel to a rotation axis of the photosensitive body, activates the picture element line containing each picture element while each picture element contained in each picture element string in the picture element array is passing sequentially on a same spot on a surface of the photosensitive body, with rotation of the photosensitive body.

Also, a preferable mode is one wherein the number of picture elements in each picture element string activated by the vertical scanning circuit is able to be changed.

By configuring as above, a surface potential of the photosensitive body can be controlled and, as a result, an amount of toner to be deposited on the surface of the photosensitive body can be changed, thus allowing multiple gray scale printing.

Also, a preferable mode is one wherein the picture elements constituting said picture element array are divided into a plurality of groups of picture elements in directions of a same line and of a same string and wherein, while the number of picture elements constituting the group of picture elements to be activated by the vertical scanning circuit is being changed, activation of the picture elements is performed for every group of the picture element of the same line.

By configuring as above, multiple gray scale printing is made possible by inputting binary data.

Furthermore, a preferable mode is one that wherein includes a detecting sensor for detecting positional deviation of insertion in a direction vertical to a direction of travelling of an object to which a toner image is transferred from the photosensitive body and a shift register for shifting data signals in the horizontal scanning circuit to correct the detected positional deviation.

By configuring as above, degradation of print quality caused by the positional deviation of insertion of the object to be printed can be corrected with accuracy.

BRIEF DESCRIPTION OF THE DRAWINGS

The above and other objects, advantages and features of the present invention will be more apparent from the following description taken in conjunction with the accompanying drawings in which.

DETAILED DISCRIPTION OF THE PREFERRED EMBODIMENTS

Best modes of carrying out the present invention will be described in further detail using various embodiments with reference to the accompanying drawings.

First Embodiment

Figure 1:
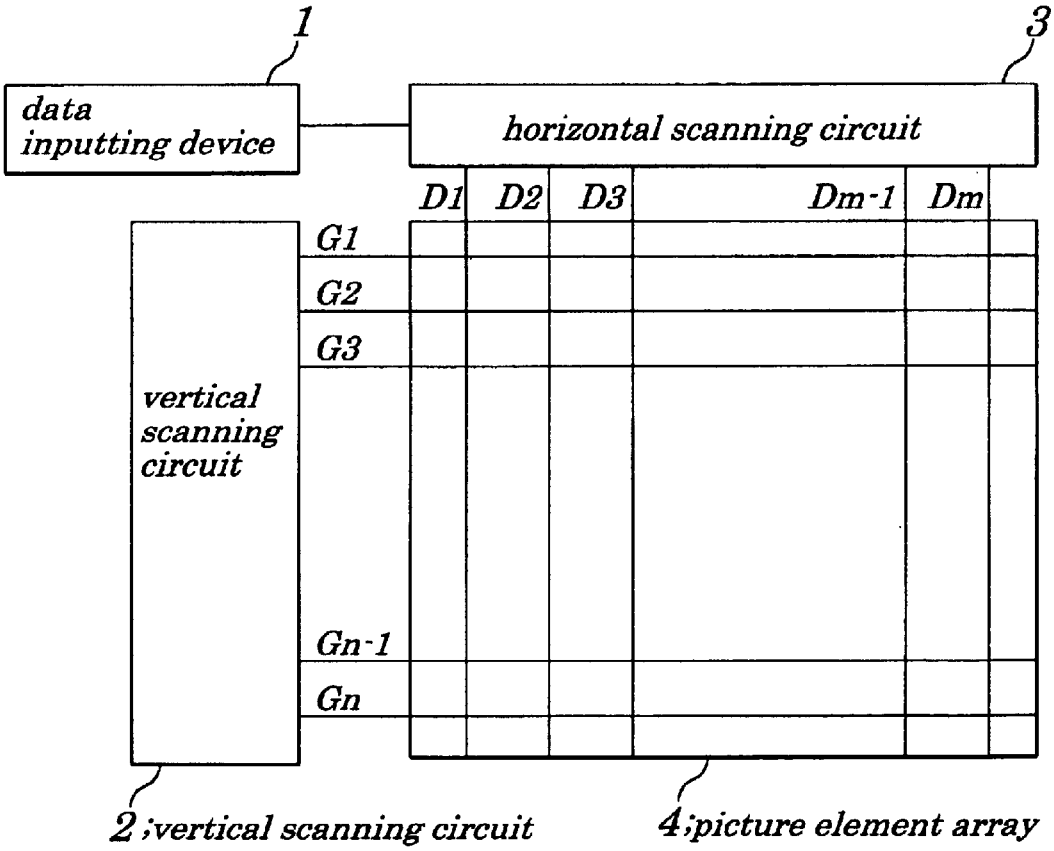
FIG. 1 is a schematic block diagram of an optical printer head according to a first embodiment of the present invention.
Figure 2A:
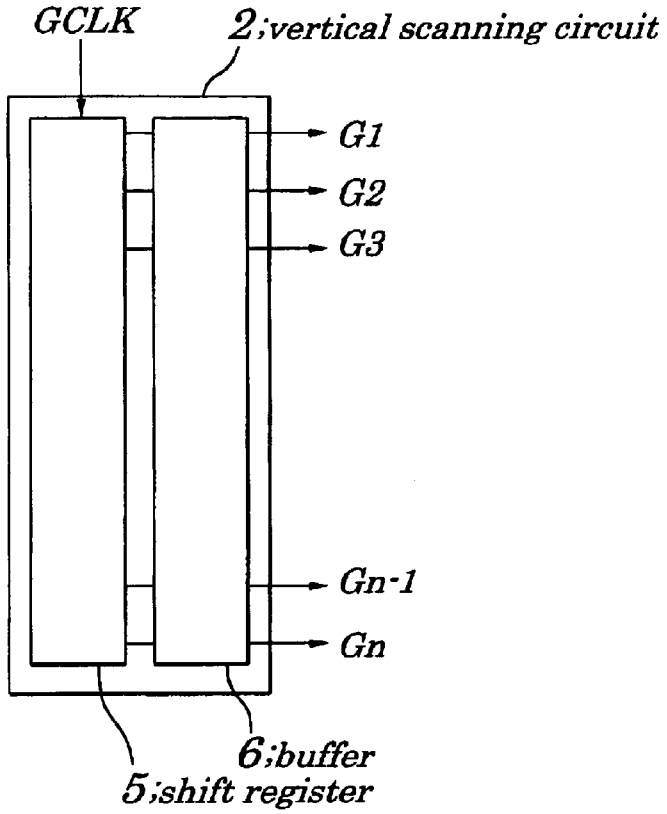
FIGS. 2A and 2B are schematic block diagrams showing configurations of peripheral circuits according to the first embodiment of the present invention.
Figure 2B:
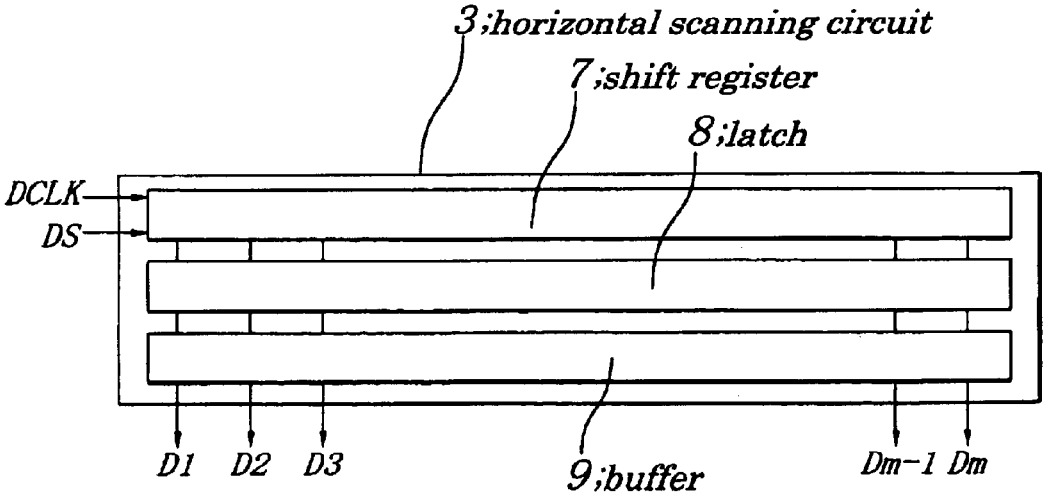
Figure 3:
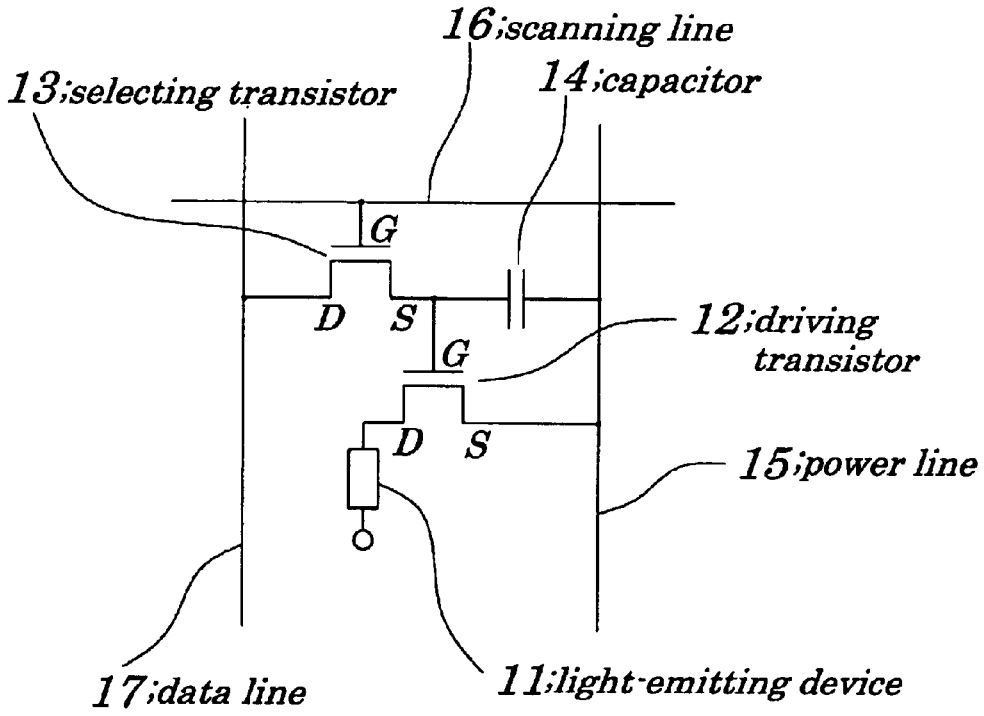
FIG. 3 is a circuit diagram showing configurations of a picture element according to the first embodiment of the present invention.
Figure 4:
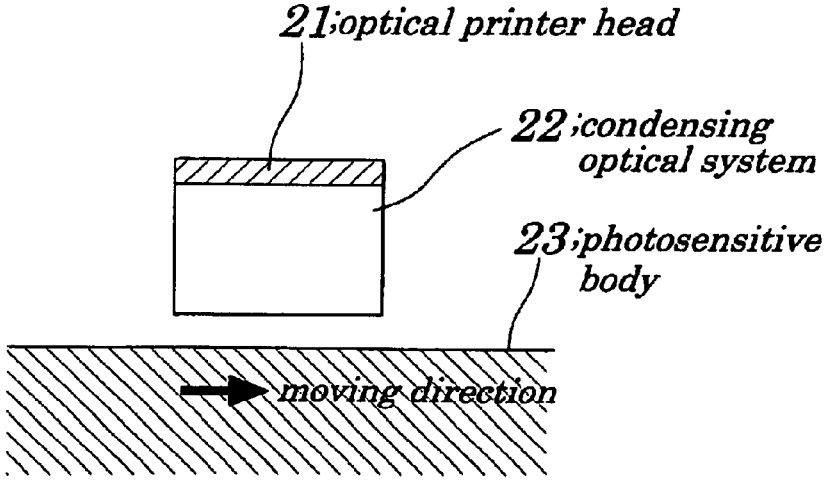
FIG. 4 is a schematic block diagram of a light-emitting face of an optical printer using the optical printer head according to the first embodiment of the present invention.
Figure 5:
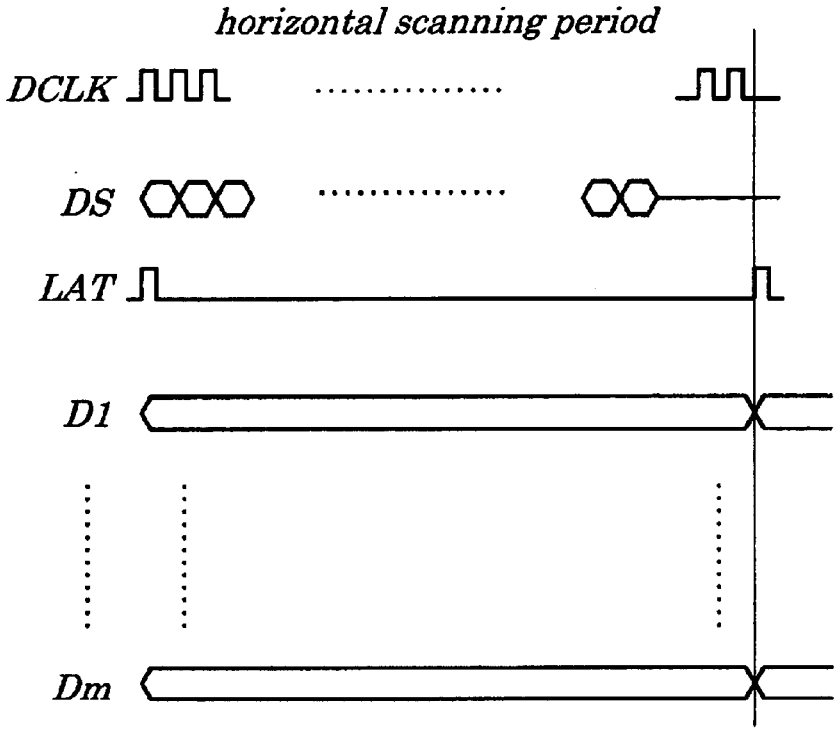
FIG. 5 is a timing chart explaining a method for driving a horizontal scanning circuit according to the first embodiment of the present invention.
Figure 6:
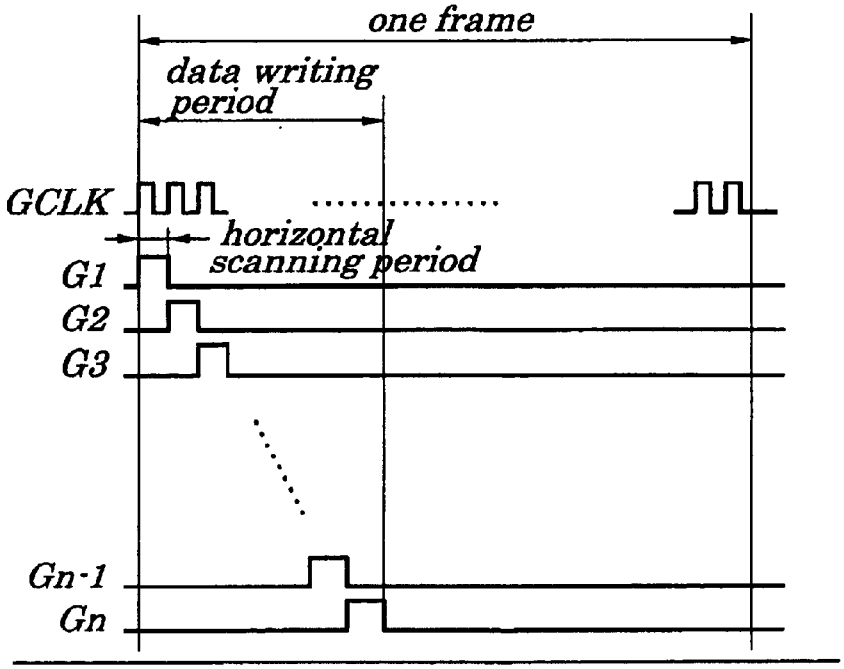
FIG. 6 is a timing chart explaining a method for driving a vertical scanning circuit according to the first embodiment of the present invention.
Figure 7A:
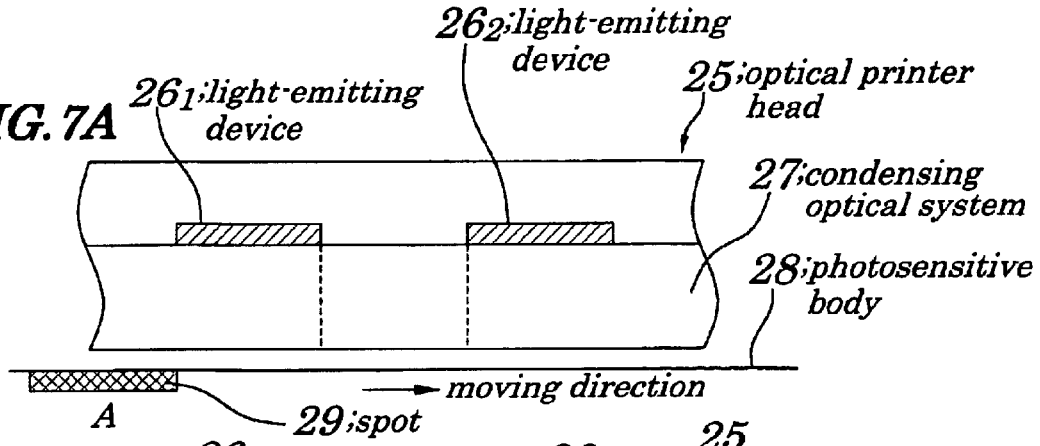
FIGS. 7A to 7D are diagrams explaining operations of exposure in the optical printer head according to the first embodiment of the present invention.
Figure 7B:
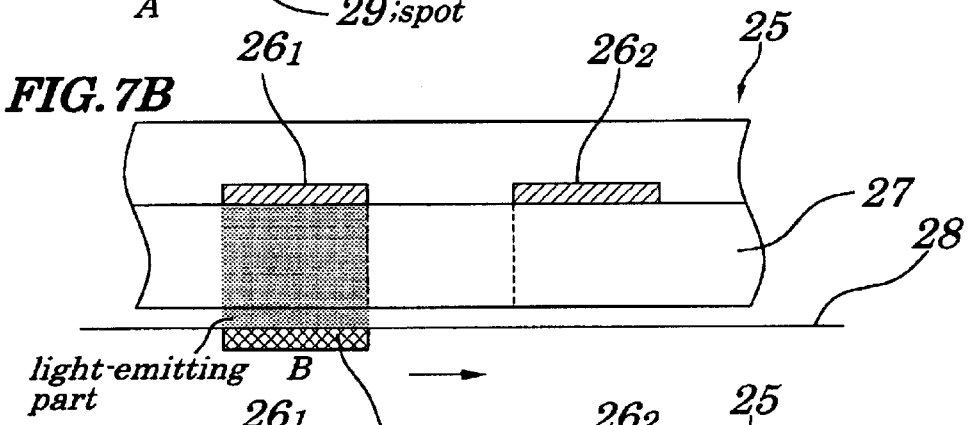
Figure 7C:
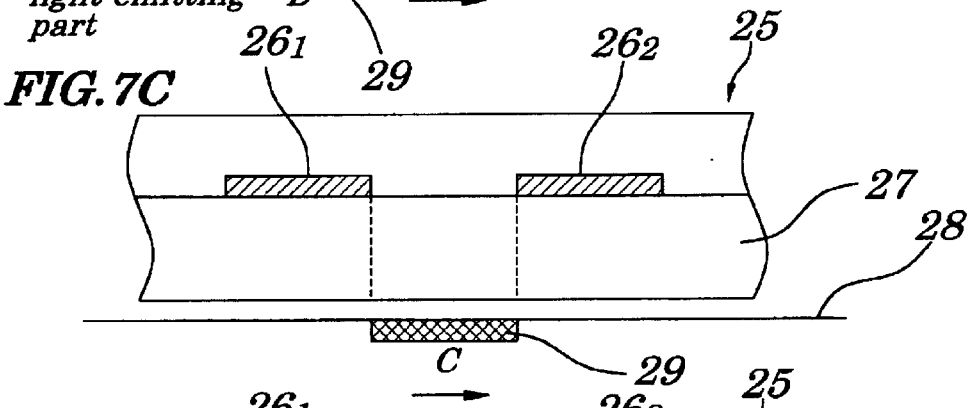
Figure 7D:
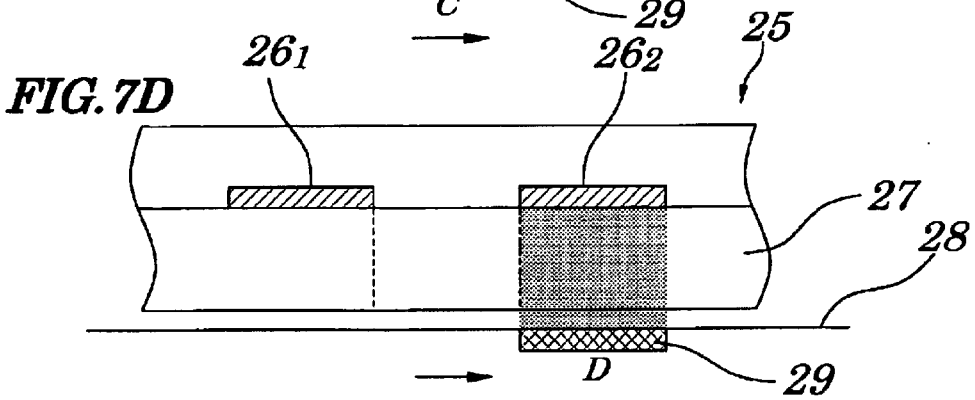
Figure 8:
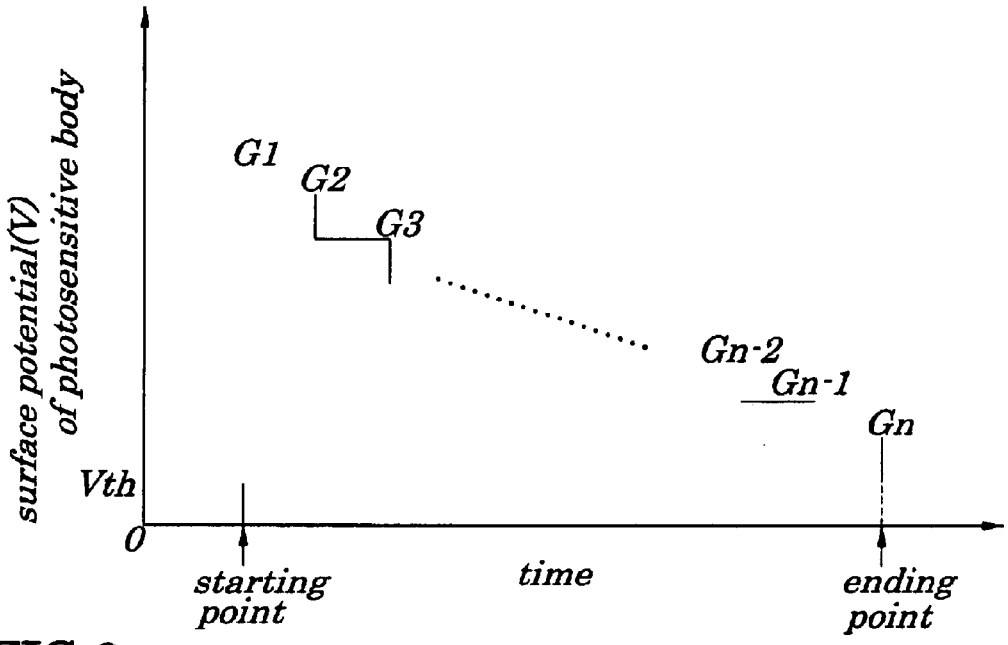
FIG. 8 is a graph showing changes in potentials in a spot portion on a surface of a photosensitive body according to the first embodiment of the present invention.

FIG. 1 is a schematic block diagram of an optical printer head according to a first embodiment of the present invention. FIGS. 2A and 2B are schematic block diagrams showing configurations of peripheral circuits according to the first embodiment. FIG. 3 is a circuit diagram showing configurations of a picture element according to the first embodiment. FIG. 4 is a schematic block diagram of a light-emitting face of an optical printer using the optical printer head according to the first embodiment. FIG. 5 is a timing chart explaining a method for driving a horizontal scanning circuit according to the first embodiment. FIG. 6 is a timing chart explaining a method for driving a vertical scanning circuit according to the first embodiment. FIGS. 7A to 7D are diagrams explaining operations of exposure in the optical printer header according to the first embodiment. FIG. 8 is a graph showing changes in potentials in a spot portion on a surface of a photosensitive body (photosensitive drum) according to the first embodiment.

The optical printer head of the first embodiment, as shown in FIG. 1, is chiefly composed of a data inputting device 1, a vertical scanning circuit 2, a horizontal scanning circuit 3 and a picture element array 4. The data inputting device 1 feeds external input data to the horizontal scanning circuit 3. The vertical scanning circuit 2 scans a picture element array 4 in a vertical direction. The horizontal scanning circuit 3 scans the picture element array 4 in response to the input data. The picture element array 4 is composed of a plurality of picture elements arranged in two dimensions, containing "m" (m being an integer of 2 or more) lines in the vertical direction and "n" (n being an integer of 2 or more) strings in the horizontal direction. Hereafter, the strings of the picture elements in the vertical direction (G1, G2, . . . , Gn-1, Gn) are called a "vertical picture element string" and the strings of the picture elements in the horizontal direction (D1, D2, . . . , Dm-1, Dm) are called a "horizontal picture element string".

As shown in FIG. 2A, the vertical scanning circuit 2 is composed of a shift register 5 and a buffer 6. In the shift register 5, a plurality of binary devices is arranged in order in the vertical direction in a manner that the binary devices correspond to vertical picture element strings and pulses of vertical clocks GCLK are transmitted in the vertical direction. In the buffer 6, a plurality of amplifying devices is arranged in order in the vertical direction in a manner that the amplifying devices correspond to the vertical picture element strings and each of the amplifying devices amplifies an output of each of the binary devices mounted in the shift register and produces outputs corresponding to the vertical picture element strings G1, G2, . . . , Gn-1, Gn.

As shown in FIG. 2B, the horizontal scanning circuit 3 is composed of a shift register 7 and a buffer 9. In the shift register 7, a plurality of binary devices is arranged in order in a manner that the binary devices correspond to the vertical picture element strings in the horizontal direction and print data DS composed of m bits of serial signals input from the data inputting device 1 is shifted in order in the horizontal direction in response to horizontal clocks DCLK. A latch 8 is so constructed that a plurality of holding devices is arranged in order in the horizontal direction in a manner that the holding devices correspond to horizontal picture element strings in the horizontal direction and that it latches output data from each of the binary devices mounted in the shift register 7. In the buffer 9, a plurality of amplifying devices is arranged in order in the horizontal direction in a manner that the amplifying devices correspond to the horizontal picture element strings and produces outputs corresponding to the horizontal picture element strings D1, D2, . . . , Dm-1, Dm.

As shown in FIG. 3, each of the picture elements is composed of a light-emitting device 11, a switching transistor to drive the light-emitting device, driving transistor 12, a switching transistor, selecting transistor 13, to select the light-emitting device 11 and a capacitor 14. The light-emitting device 11 emits light when connected to a power line 15 via the driving transistor 12. A drain D of the driving transistor 12 is connected to an electrode of the light-emitting device 11, its source is connected to the power line 15 and its gate G is connected to the source of the selecting transistor 13. A gate G of the selecting transistor 13 is connected to a scanning line 16 and its drain D is connected to a data line 17 and its source S is connected to the power line 15 through the capacitor 14. To the scanning line 16 is connected an output terminal of the vertical scanning circuit 2 corresponding to the picture element. To the data line 17 is connected an output terminal of the horizontal scanning circuit 3 corresponding to the picture element. The light-emitting device 11, driving transistor 12 and selecting transistor 13 may be arranged on an insulating substrate in any way so long as the connections are established within each of the picture elements in a same manner as described above. Light from the light-emitting device 11 may be taken out either in a direction in which the light transmits through the insulating substrate or in a direction in which it does not so long as the light is taken out in a direction in which an angle being vertical or almost vertical to the insulating substrate is formed.

Configurations of a light-emitting surface of the optical printer using the optical printer head of the embodiment are shown in FIG. 4. As shown in FIG. 4, the light-emitting surface of a optical printer head 21 contacts one end of a condensing optical system 22. The other end of a condensing optical system 22 is adapted to face a photosensitive body at a distance. The optical printer head 21 and condensing optical system 22 moves, for example, in a direction shown in FIG. 4, in parallel at a constant speed, relative to the photosensitive body. Any condensing optical system 22 may be used so long as a photosensitive body 23 is irradiated effectively with light emitted from the light-emitting device of the optical printer head 21. Such optical systems include, for example, an optical fiber array, SELFOC lens array, microlens array or a like. The vertical scanning circuit 2 and horizontal scanning circuit 3 may be fabricated by using either single crystal silicon or poly-crystal silicon. A method using the poly-crystal silicon has an advantage that these scanning circuits and picture element arrays can be formed simultaneously on the insulating substrate composed of a glass substrate. The driving transistor 12 and selecting transistor 13 contained in the element picture array 4 may be formed by any one of single crystal silicon or amorphous silicon, poly-crystal (polysilicon). Either of a p-channel transistor or n-channel transistor may be used for the driving transistor and selecting transistor. Any light-emitting device may be used as the light-emitting device 11 so long as it is a spontaneous light-emitting device and particularly preferably an organic EL device is used.

The organic EL device is basically of a picture element electrode/light-emitting layer/oppositely-placed electrode structure, that is, the structure with the light-emitting layer interposed between the picture element electrode and oppositely-placed electrode. However, the present invention is not limited to this; the organic EL device may be of a picture element electrode/hole injection layer/light-emitting layer/oppositely placed electrode structure or of a picture element electrode/hole injection layer/light-emitting layer/oppositely-placed electrode or of a picture element electrode/hole injection layer/oppositely-placed electrode structure. In any case, the light-emitting layer is formed by at least one or more of organic light-emitting materials.

Next, operations of the optical printer head of the embodiment will be hereinafter described by referring to FIGS. 1 to 8. Moreover, in the description below, time required for the photosensitive body 23 to move by one picture element in the picture element array 4 is called a "one frame period", time required to write data on all picture elements in the picture element array 4 is called a "data writing period" and time required for the horizontal scanning circuit 3 to scan all horizontal picture elements is called a "horizontal scanning period".

As shown in FIGS. 2B and 5, print data composed of serial signals output from the data inputting device 1, in synchronization with horizontal clocks DCLK being clock signals to drive the horizontal scanning circuit 3 is input to the shift register 7 of the horizontal scanning circuit 3, which causes serial data being equivalent to the number of horizontal picture elements to be converted to parallel data and to be held by the latch 8. The parallel data held by the latch 8, when a latch signal LAT is fed to the latch 8, is output to the data line 17 corresponding to the horizontal picture element strings D1, D2, . . . Dm-1, DM.

As shown in FIG. 6, the vertical scanning circuit 2 scans the vertical picture element strings G1 to Gn sequentially during a data writing period in synchronization with vertical clocks GCLK and feeds a driving pulse to the gate of the selecting transistor 13 contained in each picture element in the picture element array 4 which causes each picture element to be activated. The term "to be activated" equals a state in which the light-emitting device of each picture element emits light or stops emitting the light in accordance with print data fed through the driving transistor 12 when the selecting transistor 13 is turned ON. The data writing period, when crosstalk among picture elements is considered, is preferably shorter. Thus, in the driving circuit driven by the optical printer head of the first embodiment, desired exposure can be provided by data writing performed in synchronization with movements of the photosensitive body, that is, by rotation of the photosensitive drum. While a driving pulse (scanning signal) is being input from the vertical scanning circuit 2 through the scanning line 16, when print data signal is fed from the horizontal scanning circuit 3 through the data line 17 to the drain of the selecting transistor 13 in the picture element, a print data signal passed through the selecting transistor 13 causes the capacitor 14 to be charged. When the inputting of the driving pulse from the vertical scanning circuit 2 is stopped, the selecting circuit 13 is turned OFF. The driving transistor 12, when the capacitor 14 is at a high potential, is turned ON, thereby applying power from the power line 15 to the electrode of the light-emitting device 11 and making the light-emitting device turn ON the light. When the inputting of the driving pulse from the scanning line 16 is terminated, both the selecting transistor 13 and driving transistor 12 are turned OFF as the capacitor discharges due to a leakage current from the selecting transistor 13, which causes the light-emitting device 11 to stop emitting light and to turn OFF the light. The writing of a print data image on the surface of the photosensitive body 23 is performed by the above ON and OFF of light.

Next, operations of exposure of the optical printer head of the embodiment will be described below by referring to FIGS. 7A to 7D. As shown in FIGS. 7A to 7D, an optical printer head 25 is so constructed that a surface of the optical print head 25 is parallel to that of a photosensitive body 28. A small spot 29 moves with constant velocity on a surface of the photosensitive body 28 in a direction defined by rotation of a drum-shaped photosensitive body 28. Let it be assumed that the spot 29 is placed on a position A as shown in FIG. 7A. At this point, the spot 29 is not placed under any of light-emitting device $\mathbf{26}_1$ and light-emitting device $\mathbf{26}_2$ and both these devices are in an OFF state and emitting no light. When the spot 29 moves then to a position B, shown in FIG. 7B, under the light-emitting device $\mathbf{26}_1$, the device $\mathbf{26}_1$ is controlled so as to emit light and the spot 29 is irradiated with light by the light-emitting device $\mathbf{26}_1$. As shown in FIG. 7C, when the spot 29 moves then to a position C, the device $\mathbf{26}_1$ is in an OFF state and emitting no light. As shown in FIG. 7D, the spot 29 then moves to a position D under the light-emitting device 262, the light-emitting device $\mathbf{26}_2$ is controlled so as to emit light and the spot 29 is irradiated with light by the light-emitting device $\mathbf{26}_2$.

Though a voltage of several hundreds of volts to thousands of volts is placed on the photosensitive body 28, when a spot 29 is irradiated with light emitted from the light-emitting device $\mathbf{26}_1$ or $\mathbf{26}_2$, a surface potential of the photosensitive body 28 or a like. Thus, the surface potential of the photosensitive body 28, as shown in FIG. 8, is lowered step-wise depending on a degree of exposure. Line numbers G1, G2, . . . , Gn-1 and Gn in FIG. 8 correspond to line numbers G1, G2, . . . , Gn-1 and Gn shown in FIG. 1. Data writing is started from a first line as a starting point and a picture element existing in the first line emits light and exposes the photosensitive body 28. The exposure operation is performed in order on a picture element existing in each line in response to driving pulses fed from the vertical scanning circuit 2 and the surface potential of the photosensitive body 28 is lowered sequentially, and when the surface potential is lowered to a level of Vth shown in FIG. 8, the exposure operation is terminated. Potential Vth is a minimum threshold voltage required for exposure, which is determined by characteristics and/or development processes. Thus, according to the first embodiment, since consecutive and accumulative exposure on the same spot 29 by a plurality of light-emitting devices is made possible, even if each of the light-emitting devices emits a small amount of light, desired amounts of exposure can be provided.

As described above, according to the optical printer head of the first embodiment, since both thin film light-emitting device arrays arranged in two dimensions and the driving circuit to drive the arrays are formed on the same substrate, high density and miniaturization of the printer head are made possible and since the exposure is repeated on the same spot two or more times, desired amounts of exposure can be provided even if the light-emitting device with small amounts of emitted light is used.

Second Embodiment

Figure 9:
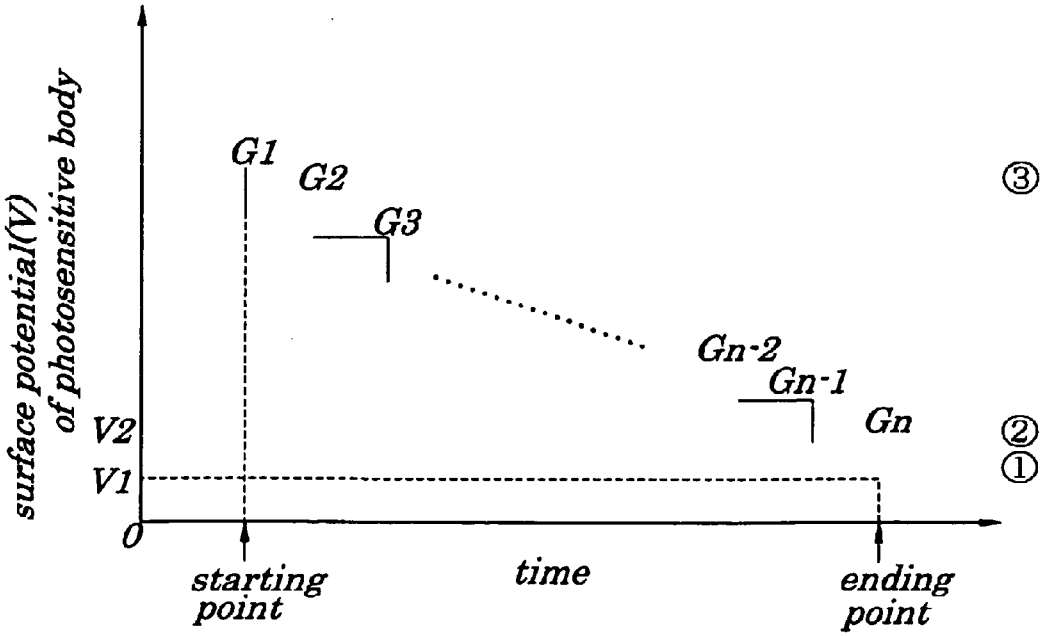
FIG. 9 is a graph showing changes in potentials in a spot portion on a surface of a photosensitive body according to a second embodiment of the present invention.
Figure 10:
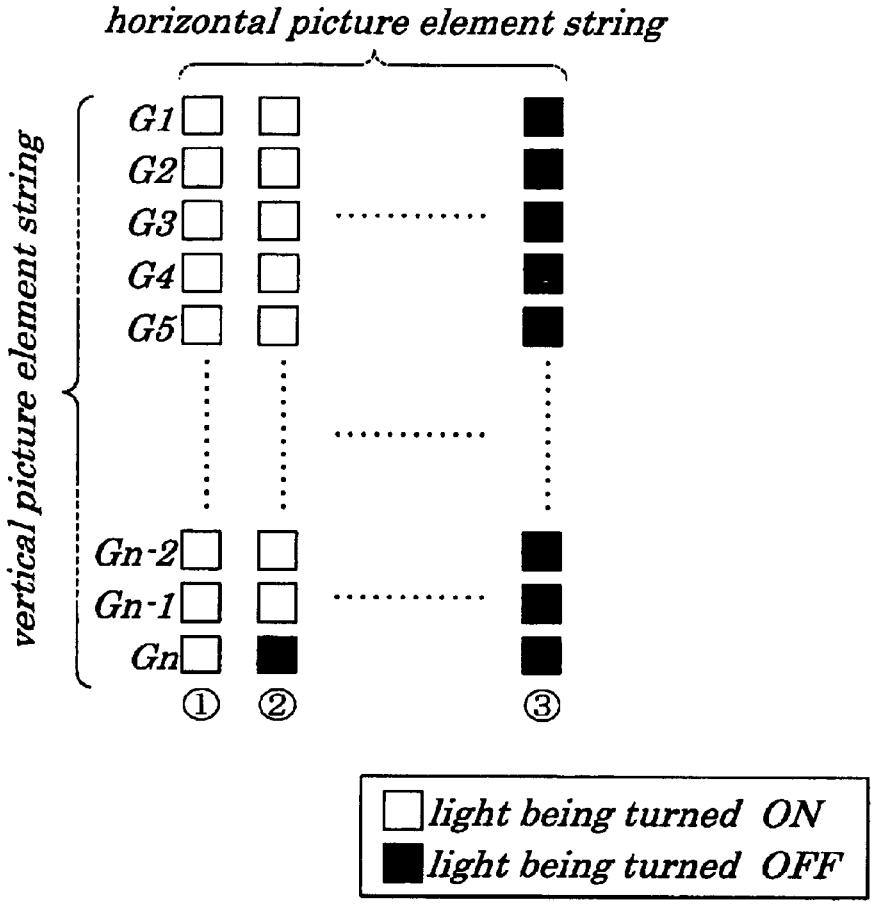
FIG. 10 is a schematic block diagram explaining operations of a picture element array according to the second embodiment of the present invention.

FIG. 9 is a graph showing changes in potentials in a spot portion on a surface of a photosensitive body according to a second embodiment of the present invention. FIG. 10 is a schematic block diagram explaining operations of a picture element array according to the second embodiment. Configurations of an optical printer head and of a picture element of the second embodiment are basically same as those of the first embodiment shown in FIG. 1 and FIG. 3 respectively. Exposure operations of the second embodiment are also basically same as those of the first embodiment shown in FIG. 7. However, operations of a vertical scanning circuit of the second embodiment differs greatly from that of the first embodiment in that, in the vertical scanning circuit of the first embodiment, though all of the number of the light-emitting devices are driven in a vertical direction while exposure operations are carried out until surface potential of the photosensitive body reaches threshold voltage Vth and they are always constant, in the vertical scanning circuit of the second embodiment, the number of light-emitting devices driving in the vertical direction is changed which causes a surface potential of a photosensitive body 23 to be controlled, thus enabling tone printing. When development is performed, electrically charged toner is deposited on a surface of the photosensitive body 23 and a toner image is formed. An amount of deposited toner changes depending on the surface potential of the photosensitive body 23. The lower the surface potential, the more amount of deposited toner. Since the surface potential of the photosensitive body 23 is gradually lowered by removal of charges through exposure, by changing an amount of exposure on the photosensitive body 23, a final surface potential of the photosensitive body 23 can be controlled.

According to the second embodiment, by controlling the number of light-emitting devices driving in the vertical direction to change the amount of the exposure, the surface potential of the photosensitive body 23 is controlled and the amount of the toner deposited on the photosensitive body 23 is changed, thus enabling printing in multiple gray scales. Control of the number of light-emitting devices driving in the vertical direction can be made by changing the number of picture elements arranged in the vertical direction to be scanned for one frame period by the vertical scanning circuit in response to tone signals fed from outside.

Operations of the optical printer head of the second embodiment will be described by referring to FIGS. 9 and 10.

If the number of vertical picture elements used for scanning is set to its maximum and all of "n" pieces of picture elements out of the vertical picture element strings G1, G2, . . . , Gn-1 and Gn in a picture element array 4 as shown in FIG. 10 ① are ON and are used to expose the photosensitive body 23, the surface potential of the photosensitive body 23 is lowered to a voltage of V1 as shown in the graph in FIG. 9 ①. Next, if the number of vertical picture elements used for scanning is set to a lower number and, for example, "n-1" pieces of the vertical picture elements including G1 to Gn-1 out of the vertical picture element strings G1, G2, . . . , Gn-1 and Gn are ON and used to expose the photosensitive body 23 as shown in FIG. 10②, the surface potential of the photosensitive body 23 is lowered to a voltage of V2 shown in the graph in FIG. 9 ②, which is different from a case shown in FIG. 9 ①. Moreover, if all the picture elements are turned OFF as shown in FIG. 10 ③, the surface potential of the photosensitive body 23 is not lowered at all as shown in the graph in FIG. 9 ③.

Thus, according to the second embodiment, since the number of light-emitting devices in the vertical picture element strings is controlled and the surface potential of the photosensitive body can be changed, it is possible to achieve tone-balanced printing.

A correlation between the surface potential of the photosensitive body and the amount of exposure is not always linear. If the correlation is linear, it is possible to perform tone-printing by controlling the light-emitting picture element by one of the picture elements, however, if the photosensitive body has a linear photosensitive characteristic, there may be a case where a voltage drop may not occur not only in even one of the light-emitting element but also in an area. In such a case, to be able to perform tone printing, it is necessary to cause two or more light-emitting devices to emit light and to change the amount of exposure on a spot. According to the second embodiment, since the amount of exposure can be adjusted arbitrarily, desired exposure can be provided even on the photosensitive body having the non-linear sensitivity characteristic.

Thus, according to the optical printer head of the second embodiment, since the number of light-emitting picture elements in the vertical picture element strings is changed by controlling the number of vertical scanning picture elements, surface potential of the photosensitive body can be controlled, thus allowing amount of toner deposited on the surface of the photosensitive body to be changed and enabling printing on multiple gray scales.

Third Embodiment

Figure 11:
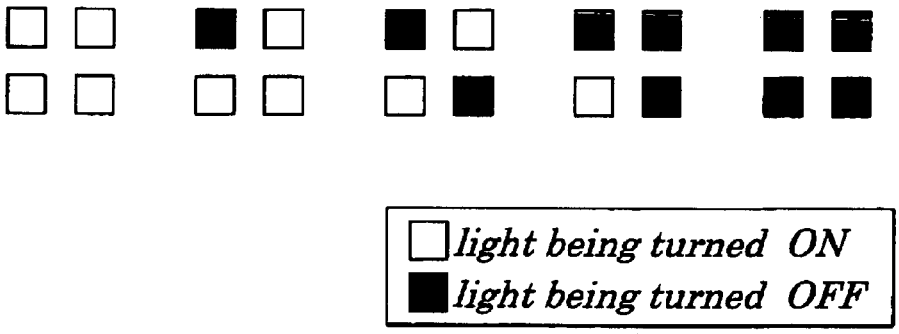
FIG. 11 is a schematic block diagram showing configurations and operations of each picture element according to a third embodiment of the present invention.

FIG. 11 is a schematic block diagram showing configurations and operations of each picture element according to a third embodiment of the present invention. Configurations of an optical printer head of the third embodiment are same as those in the first embodiment shown in FIG. 1. Exposure operations of the optical printer head are basically same as those in the first embodiment shown in FIG. 7. However, the optical printer head of the third embodiment differs from that in the first and second embodiments in that, in the first and second embodiments, each picture element constituting a picture element array 4 is composed of a single picture element, while, in the third embodiment, each picture element constituting the picture element array 4 is composed of a plurality of picture elements and a group of such picture elements composed of two or more picture elements is driven as a unit and, by controlling the number of light-emitting devices constituting the group of picture elements, amounts of light to be emitted in each group of picture elements can be changed.

Operations of the optical printer head of the third embodiment are described below by referring to FIG. 11. The "n" lines and "m" strings of picture elements constituting the picture element array 4 are divided into groups of k lines and j lines of picture elements (k and j are integers of 2 or more) and the group of picture elements is driven as a minimum unit at a time of printing and by controlling the picture elements to be driven by each group of picture elements to change the number of light-emitting devices, amounts of light to be emitted can be adjusted in multiple steps by each group of picture elements. That is, in the example shown in FIG. 11, each group of picture elements is composed of two lines and two strings (that is, k=j=2) of picture elements and amounts of emitted light can be obtained in five steps by each group of the picture element, including a case where all four picture elements are turned ON to a case where all four picture elements are turned OFF. By configuring as above, amounts of exposure on each spot on the photosensitive body 23 can be obtained in five steps, thus allowing multiple gray scale printing.

In an ordinary case, to perform tone printing, such information as can provide an amount of light that changes in an analog manner is required and, therefore, when multiple gray scale printing has to be performed, an amount of data to be input increases and a scale of a driving circuit becomes very large. However, according to the third embodiment, by using comparatively simple driving circuits and by inputting binary data, multiple gray scale printing can be made possible.

Thus, in the optical printer head of the third embodiment, since picture elements constituting the picture element array are divided into the group of picture elements composed of two or more picture elements and the number of picture elements contained in each of the groups is changed, by simply inputting binary data, multiple gray scale printing can be achieved.

Fourth Embodiment

Figure 12:
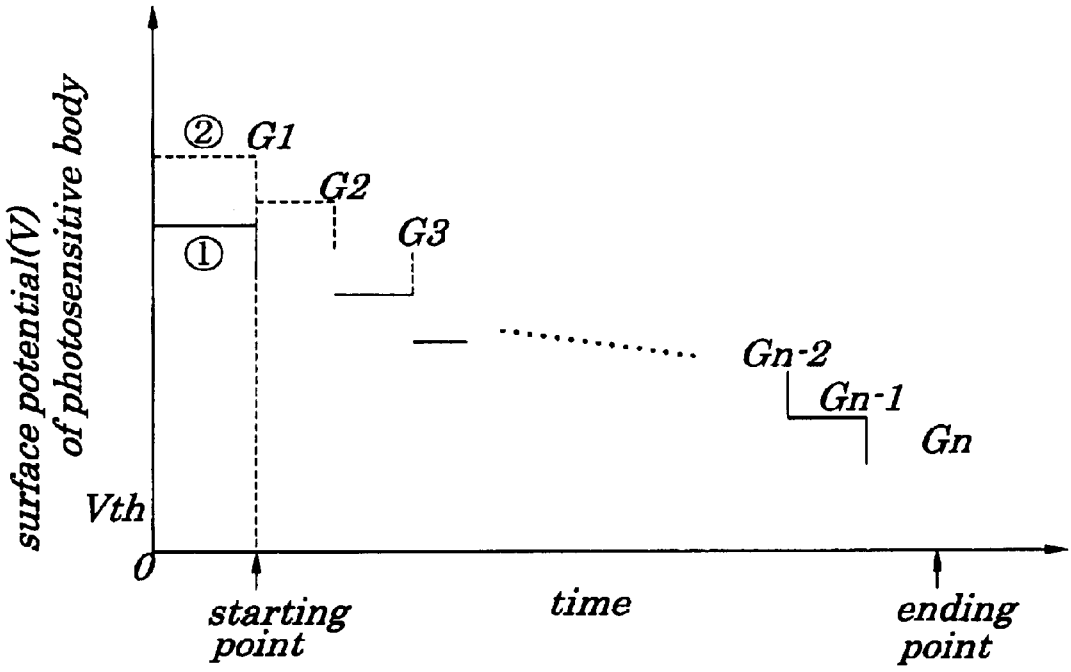
FIG. 12 is a graph showing changes in potentials in a spot portion on a surface of a photosensitive body according to a fourth embodiment of the present invention.
Figure 13:
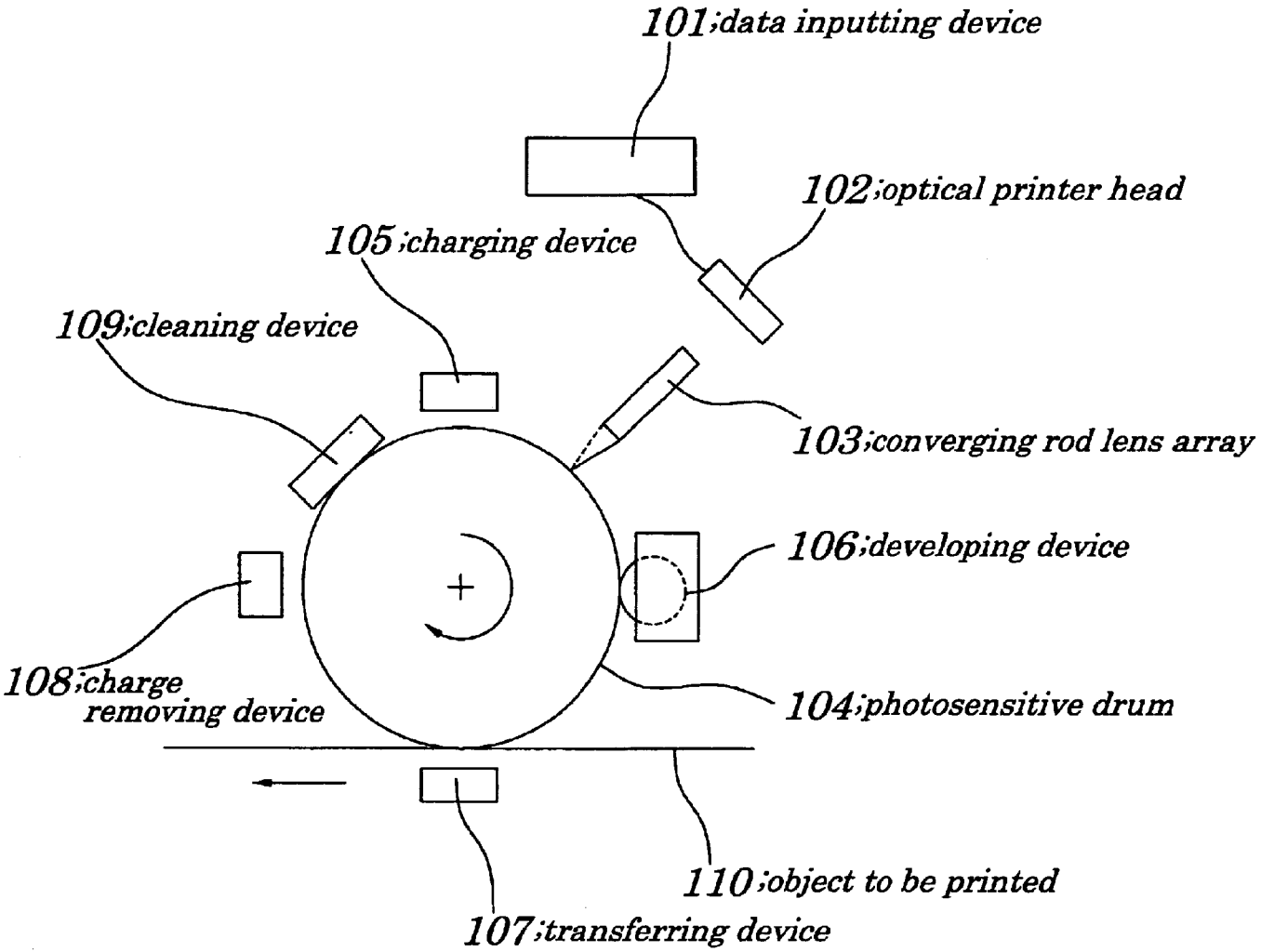
FIG.13 (PRIOR ART)
FIG. 13 is a side view showing overall configurations of a conventional optical printer using a line illuminant.

FIG. 12 is a graph showing changes in potentials in a spot portion on a surface of a photosensitive body according to a fourth embodiment of the present invention. Configurations of an optical printer head, peripheral circuits and picture element, methods for driving a horizontal scanning circuit and vertical scanning circuit and exposure operations of the fourth embodiment are same as those in the first embodiment shown in FIGS. 1 to 7. However, the optical printer head of the fourth embodiment differs greatly from that in the first, second and third embodiments in that, by changing an amount of light to be emitted from a light-emitting device of each picture element constituting a picture array, tone-balanced printing is made possible.

Generally, if an amount of exposure on the photosensitive body having a certain surface potential is small, since a toner is not developed in accordance with the surface potential of the photosensitive body, an output image tends to be too white on a low image density side. For example, if an amount of light to be emitted from a light-emitting device of each picture element in vertical picture element strings of a picture array 4 is equal, since surface potentials of photosensitive body corresponding to vertical picture element strings G1, G2, . . . , Gn-1 and Gn change as shown in FIG. 12 ①, the output image becomes too white on the low image density side, an amount of light emitted from a light-emitting device of the vertical picture element G1, out of the vertical picture element strings, which first exposes a spot on a photosensitive body, is increased enough to correspond approximately to a surface potential of the photosensitive body to be exposed by the vertical picture element G2 existing on a high image density side, as shown in FIG. 12 ①. Similarly, when necessary, an amount of light to be emitted from the vertical picture element G2 is increased enough to correspond approximately to a surface potential of the photosensitive body to be exposed by the vertical picture element G3. Thus, by setting the amount of light to be emitted by the light-emitting device of each line constituting the picture element array 4 so as to be changed by each line in the vertical direction, a tendency that the output image becomes too white on the low image density side can be corrected.

Various methods are available to change the amount of light to be emitted from the light-emitting device of each picture element, including increasing of currents to be supplied to the light-emitting device, of an area of the light-emitting device or a like, and any method is acceptable so long as it can stably provide an arbitrary amount of light.

Thus, according to the optical printer head of the fourth embodiment, by changing the amount of light to be emitted by the light-emitting device of each picture element constituting the picture element array by each line, the amount of light to be emitted from the light-emitting device of the picture element line on the low image density side can be made larger than that of light to be emitted by the light-emitting device of each picture element line on the high image density side, thus solving the problem that output image becomes too white on the low image density side.

Fifth Embodiment

Configurations of an optical printer head and picture elements of a fifth embodiment are same as those of the first embodiment shown in FIGS. 1 and 3. Exposure operations of the optical printer head of the fifth embodiment are also same as those in the first embodiment. The optical printer head of the fifth embodiment differs greatly from that in other embodiments in that, by shifting input data to be applied to a light-emitting device in a direction of a positional deviation of insertion, exposure can be performed on a correct spot.

According to the optical printer head of the fifth embodiment, since a detecting sensor (not shown) is mounted which is adapted to detect the positional deviation of insertion in a direction vertical to a direction of travelling of an object to be printed (for example, printing paper) and a correcting device (not shown) is mounted which is adapted to shift input data based on the direction of the positional deviation of insertion and on amounts of the positional deviation, the exposure on the correct spot on the photosensitive body is made possible.

In a xerography-type printer, degradation in print quality caused by the positional deviation of insertion in a direction vertical to a direction of travelling of the object to be printed becomes a problem. In the optical printer head of the fifth embodiment, since a distance among picture elements is short, thereby implementing a high density structure, the optical printer head can shift, with high accuracy, to correct an amount of the positional deviation and can make corrections to the degradation of print quality.

Also, in the optical printer head of the fifth embodiment, by detecting the positional deviation of insertion in the direction vertical to the direction of travelling of the object to be printed and by shifting input data to be applied to each picture element based on the direction of the positional deviation of insertion and on amounts of the positional deviation, the degradation of print quality caused by the positional deviation of insertion of the object to be printed can be corrected with a high accuracy.

As described above, according to the optical printer head of the present invention, even if the light-emitting device having a small amount of emitted light is used, it is possible to perform desired exposure and multiple gray scale printing. Moreover, exposure operations in accordance with a characteristic of a surface potential of the photosensitive body to amounts of exposure is made possible. Furthermore, even when the object to be printed is inserted in a deviated manner, by shifting input data based on amounts of the positional deviation, the positional deviation can be corrected and, by inputting binary data, multiple gray scale printing can be implemented.

It is apparent that the present invention is not limited to the above embodiments but may be changed and modified without departing from the scope and spirit of the invention. For example, the optical printer head of the present invention can be used not only for xerography-type printers but also for other printing systems using other computers.

Finally, the present application claims the Convention Priority based on Japanese Patent Application No. Hei11-277564 filed on Sep. 29, 1999, which is herein incorporated by reference.

What is claimed is:

1. An optical printer head comprising:

a picture element array comprising picture elements containing light emitting devices arranged in directions of a picture element line and a picture element string in two dimensions;

a horizontal scanning circuit as one peripheral circuit to feed data signals to each picture element string in said picture element array; and a vertical scanning circuit as another peripheral circuit to sequentially select and activate each picture element line in said picture element array, wherein said horizontal scanning circuit and said vertical scanning circuit comprise poly-crystal thin-film transistors, and wherein said picture element array, said horizontal scanning circuit and said vertical scanning circuit are formed on a same insulating substrate.

2. The optical printer head according to claim 1, wherein said light-emitting device is composed of organic electroluminescence devices.

3. The optical printer head according to claim 1, further comprising a means for setting amounts of light to be emitted from said light-emitting device in picture elements constituting said picture element lines by each picture element line constituting said picture element array.

4. The optical printer head according to claim 3, wherein said vertical scanning circuit is so operated that, in a state in which said picture element array is disposed facing a surface of a photosensitive body in a manner that a direction of said picture element line is parallel to a rotation axis of said photosensitive body, said picture element line containing each picture element is activated while each picture element contained in each picture element string in said picture element array is passing sequentially on a same spot on a surface of said photosensitive body, with rotation of said photosensitive body.

5. The optical printer head according to claim 4, wherein the number of picture elements in said each picture element string activated by said vertical scanning circuit is able to be changed.

6. The optical printer head according to claim 5, wherein said picture elements constituting said picture element array are divided into a plurality of groups of picture elements in a direction of a same line and of a same string and wherein, while the number of picture elements constituting said group of picture elements to be activated by said vertical scanning circuit is being changed, activation of said picture elements is performed for every group of said picture element of said same line.

7. The optical printer head according to claim 4, wherein said picture elements constituting said picture element array are divided into a plurality of groups of picture elements in a direction of a same line and of a same string and wherein, while the number of picture elements constituting said group of picture elements to be activated by said vertical scanning circuit is being changed, activation of said picture elements is performed for every group of said picture element of said same line.

8. The optical printer head according to claim 4, wherein the positional deviation of insertion of said print head in a printer in a direction perpendicular to a direction of travelling of an object to which a toner image is transferred from said photosensitive body is detected and further comprising a shift register for shifting data signals in said horizontal scanning circuit to correct the detected positional deviation.

9. The optical printer head according to claim 1, wherein said vertical scanning circuit is so operated that, in a state in which said picture element array is disposed facing a surface of a photosensitive body in a manner that a direction of said picture element line is parallel to a rotation axis of said photosensitive body, said picture element line containing each picture element is activated while each picture element contained in each picture element string in said picture element array is passing sequentially on a same spot on a surface of said photosensitive body, with rotation of said photosensitive body.

10. The optical printer head according to claim 9, wherein the number of picture elements in said each picture element string activated by said vertical scanning circuit is able to be changed.

11. The optical printer head according to claim 10, wherein said picture elements constituting said picture element array are divided into a plurality of groups of picture elements in a direction of a same line and of a same string and wherein, while the number of picture elements constituting said group of picture elements to be activated by said vertical scanning circuit is being changed, activation of said picture elements is performed for every group of said picture element of said same line.

12. The optical printer head according to claim 9, wherein said picture elements constituting said picture element array are divided into a plurality of groups of picture elements in a direction of a same line and of a same string and wherein, while the number of picture elements constituting said group of picture elements to be activated by said vertical scanning circuit is being changed, activation of said picture elements is performed for every group of said picture element of said same line.

13. The optical printer head according to claim 9, wherein the positional deviation of insertion of said print head in a printer in a direction perpendicular to a direction of travelling of an object to which a toner image is transferred from said photosensitive body is detected and further comprising a shift register for shifting data signals in said horizontal scanning circuit to correct the detected positional deviation.

14. An optical printer head comprising:

a picture element array comprising picture elements containing light emitting devices arranged in directions of a picture element line and a picture element string in two dimensions;

a horizontal scanning circuit to feed data signals to each picture element string in said picture element array;

a vertical scanning circuit to sequentially select and activate each picture element line in said picture element array, wherein said horizontal scanning circuit and said vertical scanning circuit comprise poly-crystal thin-film transistors, and said picture element array, said horizontal scanning circuit and said vertical scanning circuit are formed on a same insulating substrate, and means for selectively controlling luminance of said picture elements.

15. An optical printer head as recited in claim 14, wherein a plurality of light emitting devices are provided in each picture element and said means for selectively controlling luminance includes means for energizing a selected plurality of said light-emitting devices.

16. An optical printer head as recited in claim 14, wherein said means for selectively controlling luminance includes means for selectively controlling energization power to said light-emitting devices.

* * * * *